US005912533A

United States Patent [19]

Lee et al.

[11] Patent Number: 5,912,533

[45] Date of Patent: Jun. 15, 1999

[54] AC POWDER ELECTROLUMINESCENCE DEVICE AND METHOD FOR MAKING THE SAME

[75] Inventors: Ju Hyeon Lee, 100, Galsan-lee, Tangjung-myun Asan-shi, Choongchungnam-do; Sung Park, Da-dong 906, Samho Garden Apt. Banpo-dong, Seocho-ku, Seoul; Vladimir Vlaskin, 100, Galsan-lee Tangjung-myun, Asan-shi, Choongchungnam-do; Sang Gook Park, Kyungsangnam-do; Il Chae Jung; In Shik Park, both of Seoul, all of Rep. of Korea

[73] Assignees: Ju Hyeon Lee, Asan-shi; Sung Park, Seoul; Vladimir Vlaskin, Asan-shi, all of Rep. of Korea

[21] Appl. No.: 08/861,540

[22] Filed: May 22, 1997

[30] Foreign Application Priority Data

May 22, 1996 [KR] Rep. of Korea ..... 96-17369
May 19, 1997 [KR] Rep. of Korea ..... 97-19283

[51] Int. Cl.[6] ..... H05B 33/26

[52] U.S. Cl. ..... 313/503; 313/509; 428/690

[58] Field of Search ..... 313/503, 505, 313/506, 512, 509; 428/690, 917; 315/169.3

[56] References Cited

U.S. PATENT DOCUMENTS

| | | | |
|---|---|---|---|
| 4,608,308 | 8/1986 | Igarashi et al. | 313/503 X |
| 4,902,567 | 2/1990 | Eilertsen et al. | 313/506 X |
| 5,200,277 | 4/1993 | Nakayama et al. | 428/690 |
| 5,476,727 | 12/1995 | Maruta | 313/512 X |

*Primary Examiner*—Ashok Patel
*Attorney, Agent, or Firm*—Oblon, Spivak, McClelland, Maier & Neustadt, P.C.

[57] ABSTRACT

The invention relates to an easily fabricated and highly luminous electroluminescence (EL) device, whose front transparent electrode is made by using transparent conductive powder and transparent conductive binder, and a method for making such an EL device. The method comprises the steps of: providing a substrate; forming a metal electrode layer on the substrate, wherein the metal electrode layer reflects light incident thereto; forming a dielectric layer comprising a mixture of dielectric powder and a binder on the metal electrode layer; forming a phosphor layer including phosphor powder and a binder on the dielectric layer; and forming a transparent electrode layer including transparent conductive powder and a transparent conductive binder on the phosphor layer using a spin coating or a screen printing process employed for liquid material.

12 Claims, 3 Drawing Sheets

AC POWDER ELECTROLUMINESCENCE DEVICE AND METHOD FOR MAKING THE SAME

BACKGROUND OF THE INVENTION

1. Field of the Invention

The present invention relates to an electroluminescence (EL) device which is activated by an alternating current (AC), and more particularly, to an easy to fabricate and highly luminous EL device having an electrode made of transparent conductive polymer and Indium-Tin-Oxide (ITO) powder.

2. Description of the Prior Art

Referring to FIG. 1, a cross-sectional view of a conventional AC EL device which is used, for example, to illuminate a passive LCD (Liquid Crystal Display) from the back is shown. The EL device shown in FIG. 1 comprises a plurality of layers including a substrate 11, a back electrode layer 10, a dielectric layer 4, a phosphor layer 6, a front electrode layer 12, and a polymer protection layer 5. Briefly describing the procedures for making the conventional EL device shown in FIG. 1, the back electrode layer 10 is first formed on top of the substrate 11. The back electrode layer 10 is made of highly reflective metal such as silver or aluminum so that the light incident to the back electrode layer 10 may be reflected therefrom. Then, the dielectric layer 4 is formed on the back electrode layer 10, wherein the dielectric layer 4 is made either of a mixture of dielectric powder and binder or of a flexible dielectric thin film. Subsequently, the phosphor layer 6, comprising a mixture of phosphor powder 7 and binder, is formed on the dielectric layer 4. Similar materials are used for the binder of the phosphor layer 6 and that of the dielectric layer 4. It should be noted that in the conventional EL device, the phosphor powder particles 7 are surrounded by the dielectric material and, therefore, the phosphor powder particles 7 do not directly contact the front electrode layer 12 as will be described below. Then, an ITO thin film, which is made of $In_2O_3$ and $SnO_2$, is laminated on the phosphor layer 6 by using vacuum evaporation, to thereby form the front electrode layer 12. It should also be noted that the vacuum evaporation process is more complicated and costly compared with processes using materials in a liquid state. Lastly, polymer is spread on the front electrode layer 12 to form the protection layer 5. One of the problems encountered with the conventional EL device is that it has relatively low luminance, thereby somewhat limiting its applicability. The luminance of a currently available EL device is about 70–80 $Cd/m^2$. However, an LCD backlighting device generally requires luminance over 100–150 $Cd/m^2$. Especially, to illuminate a STN (Super Twisted Nematic) type LCD, luminance should be at least 120 $Cd/m^2$, considering the loss of light. Another problem with the conventional EL device is related to the cost for manufacturing which can also limit the applicability of the device.

Therefore, there has been a need in the art for more luminous EL devices which have improved applicability and can be simply fabricated at a minimum cost.

SUMMARY OF THE INVENTION

It is an object of the present invention to provide an EL device which is easily fabricated and highly luminous.

It is another object of the present invention to provide a method for making such an EL device.

In accordance with one aspect of the present invention, there is provided a method for making an AC powder EL device, which comprises the steps of: providing a substrate; forming a metal electrode layer on the substrate, wherein the metal electrode layer reflects light incident thereto; forming on the metal electrode layer a dielectric layer comprising a mixture of dielectric powder and binder; forming on the dielectric layer a phosphor layer comprising phosphor powder and binder; and forming on the phosphor layer a transparent electrode layer comprising transparent conductive powder and transparent conductive binder.

In accordance with another aspect of the present invention, there is provided an illuminating device comprising: a substrate; a reflective metal electrode layer formed on the substrate; a dielectric layer formed on the reflective metal electrode layer; a phosphor layer formed on the dielectric layer; and a transparent electrode layer formed on the phosphor layer which is made of a mixture of transparent conductive powder and transparent conductive binder.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF THE INVENTION

Figure 2:
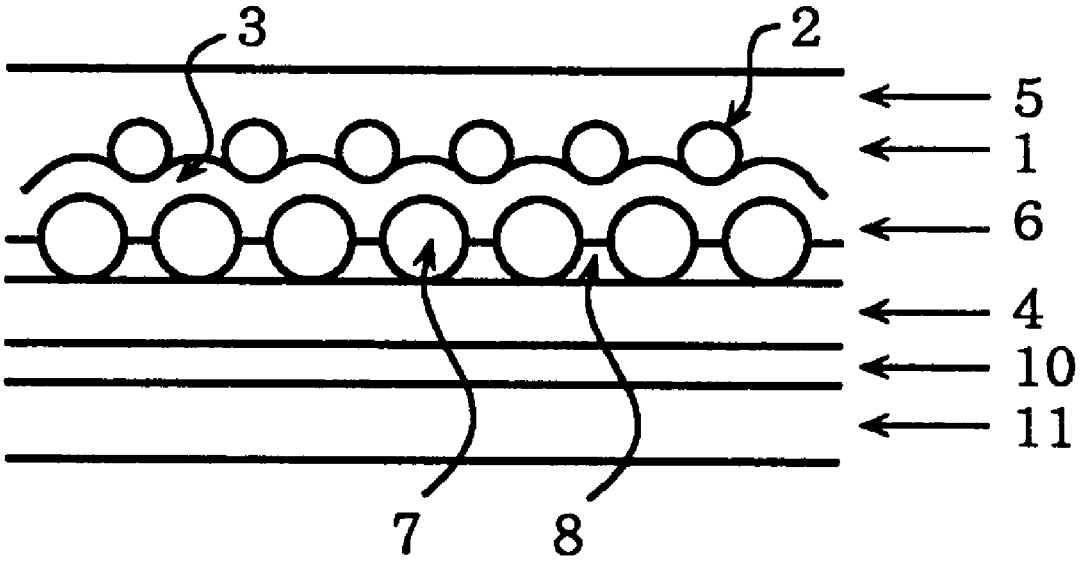
FIG. 2 shows a cross-sectional view of an EL device in accordance with a first embodiment of the present invention.

Referring to FIG. 2, a cross-sectional view of an EL device in accordance with a first embodiment of the present invention is illustrated.

Figure 1:
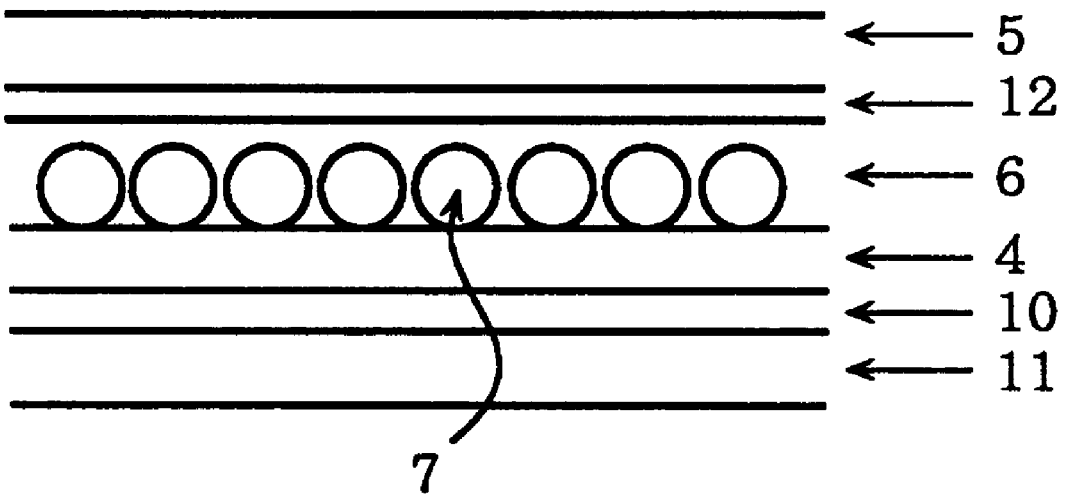
FIG. 1 shows a cross-sectional view of a conventional EL device.

The EL device shown in FIG. 2 comprises a plurality of layers including a substrate 11, a back electrode layer 10, a dielectric layer 4, a phosphor layer 6, a transparent electrode layer 1, and a polymer protection layer 5. The substrate 11, the back electrode layer 10, the dielectric layer 10 and the polymer protection layer 5 are substantially identical to those of the conventional EL device shown in FIG. 1.

To fabricate the present EL device shown in FIG. 2, the back electrode layer 10 is first deposited on top of the substrate 11. Then, the dielectric layer 4 is formed on the electrode layer 10. The dielectric layer 4 may be made of a mixture of dielectric powder and binder for binding the dielectric powder, or a dielectric thin film. The dielectric powder may be $BaTiO_3$, whose particle size is less than 3 $\mu$m. The binder, for example, may be made of a mixture of PVA (PolyVinyl Alcohol) type polymer and DMF (DiMethylFormamide) which works as a plasticizer. It should be noted that, unlike conventional binders comprising cyanoresin type material which have negative effects on a human body in case of prolonged exposure, PVA type polymer is harmless to a human body. In addition, PVA type polymer is less costly than the conventional binders. In case the dielectric layer 4 is made of a material in a liquid state, i.e., a mixture of powder and binder, the dielectric layer 4 can be easily fabricated by employing a spin coating or a screen printing method. During a spin coating process, a liquid material is poured on a substrate which is rotated so that the material is spread into a thin and uniform layer.

During a screen printing process, a liquid material is put on a gauze made of silk or stainless steel and then rubbed with a soft plastic bar to allow it to pass through the gauze thereby forming a thin and uniform layer on a substrate.

Next, the phosphor layer 6 is formed on the dielectric layer 4 by applying a mixture of phosphor powder 7 and binder 8 which binds the phosphor particles 7 together. The phosphor powder may be a II–VI group compound, e.g., ZnS. The particle size of the phosphor powder 7 ranges preferably from about 20 to 30 $\mu$m. It should be noted that the amount of the binder 8 required in the invention is less than that used in the conventional phosphor layer shown in FIG. 1. As a result, an upper part of the phosphor particles 7 is exposed to be in contact with the transparent electrode layer 1 as shown in FIG. 2.

It is possible to obtain three primary colors of light, i.e., red, green and blue, by mixing pertinent materials into the phosphor when forming the phosphor layer 6. For example, by adding Sm to ZnS, or by adding Cu, Mn and Cl to ZnS, red is obtained; by adding Tb to ZnS, or by adding Cu and Cl to ZnS, green is obtained. By adding Tm to ZnS or by adding Cu and Cl to ZnS, blue is obtained. By making a layer with a mixture of materials related to the three colors, white light can be obtained. By using color filters on the white phosphor layer, it is possible to obtain various kinds of colored light.

Subsequent to the formation of the phosphor layer 6, transparent electrode layer 1 is formed thereon by applying a mixture of ITO powder 2 and conductive binder 3. It is preferable to form the transparent electrode layer 1 by pressing the ITO powder and conductive binder 3 mixture with instant heating at the temperature of 100–200° C. so that the particles in the transparent electrode layer 1 are compactly arranged and the adhesiveness between the phosphor and transparent electrode layers is improved.

The conductive binder 3, which is highly conductive, is made by adding liquid InGa to the type of binder used in the phosphor layer 6. Therefore, the ITO powder 2, which is also conductive, together with the conductive binder 3 forms a current path so as to apply excitation to the phosphor layer 6, thereby eliminating the need for the ITO thin film of the conventional device.

As the transparent electrode layer 1 of the present invention is made of material in a liquid state instead of the ITO thin film used in the conventional device, it can be made by using the spin coating or screen printing method, thereby simplifying the fabrication process.

Moreover, as the phosphor powder 7 directly contacts the electrode layer 1, a strong electric field can be applied to the phosphor powder 7, which in turn results in enhanced luminance.

Figure 3:
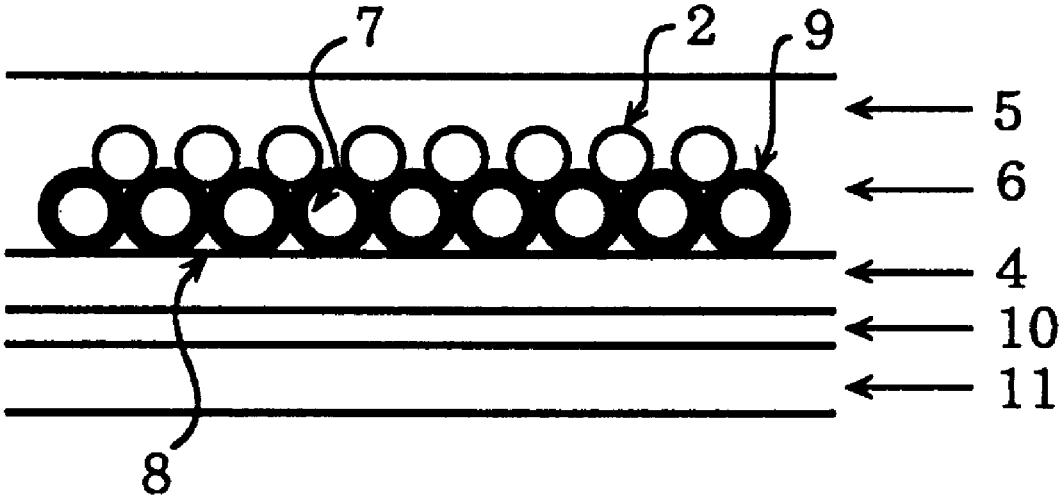
FIG. 3 shows a cross-sectional view of an EL device in accordance with a second embodiment of the present invention.

Referring to FIG. 3, there is shown a cross-sectional view of an EL device in accordance with a second embodiment of the present invention. In the second embodiment, the phosphor powder 7 is coated with liquid InGa 2 so that a highly conductive outer coating 9 is formed on the surface of each particle of the phosphor powder 7. As illustrated in FIG. 3, the amount of binder 8 used in the second embodiment is less than that in the first embodiment. The binder 8 is mainly used to make the coated phosphor powder adhere to the dielectric layer 4.

ITO powder 2 is applied on top of the coated phosphor powder. As shown in FIG. 3, the ITO powder 2 and the conductive coating 9 of the phosphor powder 7 contact each other to provide electrical continuity, so as to apply excitation to the phosphor powder 7.

It may be appreciated that the EL device shown in FIG. 3 has the same advantageous effects including the simplified process and higher luminance as mentioned in conjunction with FIG. 2.

The beneficial effects prompted by employing the present invention is summarized as follows:

Firstly, it is possible to fabricate all layers except the back electrode layer 10 by using the spin coating or the screen printing method. Therefore, the cost of the fabrication can be reduced.

Secondly, the inventive device features enhanced luminance. Specifically, the luminance of the inventive device ranges from 200 to 500 Cd/m$^2$, which is higher than that of the conventional device.

Thirdly, it is possible to produce a very thin EL device which may be as thin as 0.05 mm, with the inventive process. Therefore, by providing a transparent EL layer with a transparent electrode layer, a dielectric layer, a phosphor layer and another transparent layer stacked in order, and then by stacking a plurality of such transparent EL layers, a very bright EL device can be obtained.

While the present invention has been described with respect to the particular embodiments, it will be apparent to those skilled in the art that various changes and modifications may be made without departing from the spirit and scope of the invention as defined in the following claims.

What is claimed is:

1. An illuminating device comprising:

a substrate;

a reflective metal electrode layer formed on the substrate;

a dielectric layer formed on the reflective metal electrode;

a phosphor layer formed on the dielectric layer; and a transparent electrode layer comprising a mixture of transparent conductive powder and a transparent conductive binder formed on the phosphor layer.

2. The illuminating device as claimed in claim 1, wherein said substrate comprises a plastic thin film.

3. The illuminating device as claimed in claim 1, wherein said metal electrode layer comprises silver.

4. The illuminating device as claimed in claim 1, wherein said metal electrode layer comprises aluminum.

5. The illuminating device as claimed in claim 1, wherein the dielectric layer comprises a mixture of dielectric powder and a first binder.

6. The illuminating device as claimed in claim 5, wherein said dielectric powder contains $BaTiO_3$.

7. The illuminating device as claimed in claim 1, wherein said phosphor layer comprises a mixture of phosphor powder and a second binder.

8. The illuminating device as claimed in claim 7, wherein said phosphor powder contains a II–VI group compound.

9. The illuminating device as claimed in claim 7, wherein said phosphor powder contains a multiplicity of particles each of which is coated with a conductive outer coating.

10. The illuminating device as claimed in claim 9, wherein said conductive outer coating is made of liquid InGa.

11. The illuminating device as claimed in claim 1, wherein said transparent conductive powder contains indium tin oxide.

12. The illuminating device as claimed in claim 1, wherein said transparent conductive binder contains liquid InGa.

* * * * *

UNITED STATES PATENT AND TRADEMARK OFFICE

CERTIFICATE OF CORRECTION

PATENT NO. : 5,912,533
DATED : June 15, 1999
INVENTOR(S) : Ju Hyeon Lee, et al.

It is certified that error appears in the above-identified patent and that said Letters Patent is hereby corrected as shown below:

Title page,
Item [75], the following inventors should be deleted:

-- Sang Gook Park, Kyungsangnam-do; Il Chae Jung;
In Shik Park, both of Seoul --.

Signed and Sealed this

Sixth Day of November, 2001

*Attest:*

Nicholas P. Godici

*Attesting Officer*

NICHOLAS P. GODICI
*Acting Director of the United States Patent and Trademark Office*